US010292896B2

(12) United States Patent
Davis et al.

(10) Patent No.: US 10,292,896 B2
(45) Date of Patent: May 21, 2019

(54) SYSTEMS AND METHODS FOR PROVIDING ADAPTIVE BIOFEEDBACK MEASUREMENT AND STIMULATION

(71) Applicant: SmartBod Incorporated, Berkeley, CA (US)

(72) Inventors: Robert Davis, Berkeley, CA (US); Liang Shian Chen, Milpitas, CA (US); James Wang, Berkeley, CA (US); Elizabeth Klinger, Berkeley, CA (US); Anna Kim Lee, San Mateo, CA (US)

(73) Assignee: SMARTBOD INCORPORATED, Berkeley, CA (US)

( * ) Notice: Subject to any disclaimer, the term of this patent is extended or adjusted under 35 U.S.C. 154(b) by 644 days.

(21) Appl. No.: 14/697,231

(22) Filed: Apr. 27, 2015

(65) Prior Publication Data

US 2015/0305971 A1 Oct. 29, 2015

Related U.S. Application Data

(60) Provisional application No. 61/985,146, filed on Apr. 28, 2014.

(51) Int. Cl.
*A61H 19/00* (2006.01)
*A61H 23/02* (2006.01)

(52) U.S. Cl.
CPC ..... *A61H 19/34* (2013.01); *A61H 19/44* (2013.01); *A61H 23/02* (2013.01);
(Continued)

(58) Field of Classification Search
CPC ..... A61H 19/44; A61H 19/40; A61H 19/50; A61H 2201/0103; A61H 2201/5007;
(Continued)

(56) References Cited

U.S. PATENT DOCUMENTS 6,368,268 B1 4/2002 Sandvick et al.
6,592,516 B2 7/2003 Lee
(Continued)

FOREIGN PATENT DOCUMENTS

WO WO-2007/096595 A2 8/2007
WO WO-2013/108244 A2 7/2013
WO WO-2014/043263 A1 3/2014

OTHER PUBLICATIONS

International Search Report and Written Opinion issued by the U.S. Patent and Trademark Office as International Searching Authority for International Application No. PCT/US2015/027819 dated Jul. 27, 2015 (12 pgs.).

(Continued)

*Primary Examiner* — Samuel G Gilbert
(74) *Attorney, Agent, or Firm* — Wilmer Cutler Pickering Hale and Dorr LLP

(57) ABSTRACT

The present invention is a physiological measurement and stimulation device that can autonomously adapt its actuation output behavior based on acquired data in the form of biofeedback sensory measurements. When operating the invention, the user can place the device on the body at the intended area of operation, at which time the physiological measurements sensors can initiate data collection. Either prior to or following this time, the actuator can be activated and controlled manually and/or autonomously per a command signal generated by the control system. The operation of the present invention can be continued until the invention detects that a predetermined threshold has been reached. When the invention is used as a sexual stimulation device, the predetermined threshold can be physiological data corresponding to various stages of arousal or orgasm.

29 Claims, 10 Drawing Sheets

(52) U.S. Cl.
CPC ..... *A61H 2201/0153* (2013.01); *A61H 2201/501* (2013.01); *A61H 2201/5007* (2013.01); *A61H 2201/5061* (2013.01); *A61H 2201/5064* (2013.01); *A61H 2201/5079* (2013.01); *A61H 2201/5084* (2013.01); *A61H 2230/065* (2013.01); *A61H 2230/505* (2013.01); *A61H 2230/65* (2013.01); *A61H 2230/655* (2013.01)

(58) Field of Classification Search
CPC .... A61H 2201/0153; A61H 2201/5092; A61H 2225/66
USPC ..... 600/38–41
See application file for complete search history.

(56) References Cited

U.S. PATENT DOCUMENTS 6,659,938 B1 * 12/2003 Orlowski ..... A61F 5/41 600/38
6,695,770 B1 2/2004 Choy et al.
7,438,681 B2 10/2008 Kobashikawa et al.
7,608,037 B2 * 10/2009 Levy ..... A61H 19/44 600/38
7,828,717 B2 11/2010 Lee
7,967,740 B2 6/2011 Mertens et al.
8,308,667 B2 11/2012 Lee
8,360,954 B2 1/2013 Kim
8,496,572 B2 7/2013 Lee
8,500,627 B2 8/2013 Lee
8,512,225 B2 8/2013 Lee
8,579,837 B1 11/2013 Makower et al.
8,608,644 B1 12/2013 Davig
8,672,832 B2 3/2014 Lee
8,721,523 B2 5/2014 Lee
8,747,337 B2 6/2014 Lee
8,858,422 B2 10/2014 Lee
8,915,835 B2 12/2014 Lee
2003/0036678 A1 2/2003 Abbassi
2006/0270897 A1 11/2006 Homer
2007/0055096 A1 3/2007 Berry et al.
2009/0093856 A1 4/2009 Attila et al.
2011/0098613 A1 4/2011 Thomas et al.
2011/0218395 A1 9/2011 Stout
2012/0172661 A1 7/2012 Chiu
2013/0116503 A1 5/2013 Mertens et al.
2013/0172791 A1 7/2013 Golan
2013/0178769 A1 7/2013 Schmidt
2013/0331745 A1 12/2013 Sedic

OTHER PUBLICATIONS

Extended European Search Report dated Nov. 28, 2017 in related European Patent Application No. 15785366.4 (9 pages).

* cited by examiner

SYSTEMS AND METHODS FOR PROVIDING ADAPTIVE BIOFEEDBACK MEASUREMENT AND STIMULATION

RELATED APPLICATION

This application relates to and claims priority under 35 U.S.C. § 119(e) to U.S. Provisional Patent Application No. 61/985,146, titled "Systems And Methods For Providing Adaptive Biofeedback Measurement and Stimulation," which was filed on Apr. 28, 2014 and is incorporated herein in its entirety.

FIELD OF THE INVENTION

The present invention is in the technical field of electronic devices. More particularly, the present invention is in the technical field of physiological measurement and stimulation devices that could be used, for example, as a sexual stimulation device, a body massager and relaxation device, or a biofeedback data acquisition and processing software platform.

BACKGROUND OF THE INVENTION

Conventional sexual stimulation devices for women's internal and/or external use are typically two types: dildos and vibrators. Dildo-type devices generally provide stimulation based on the shape of the device. The development of the dildo-type devices has been primarily with respect to design aesthetics in the device's physical form, the ability to manually select multiple actuation patterns from a user-operated control panel located on the device, and the ability to manually remotely control actuation patterns over radio signals or over the Internet. Vibrator-type devices generally provide stimulation based on a combination of the shape of the device and the motions of actuators in the device. The development of the vibrator-type devices has been primarily with respect to the type of actuator used in the devices, including the use of linear induction motors or electroshock stimulation.

There are, however, several limitations related to the conventional stimulation devices. First, the conventional devices do not incorporate physiological measurement sensors, for example, heart rate and body temperature sensors, that measure physiological responses from the human body.

Second, the conventional devices do not autonomously adjust the behavior of the actuator based on physiological biofeedback data collected before, during, and/or after operation of the device.

Third, the conventional devices do not incorporate an autonomous learning functionality, in which the device adjusts its behavior based on biofeedback data collected over a period encompassing one or more uses.

Therefore, there is a need in the art to provide systems and methods for improving stimulation devices by providing adaptive biofeedback measurement and stimulation. Accordingly, it is desirable to provide methods and systems that overcome these and other deficiencies of the related art.

SUMMARY OF THE INVENTION

In accordance with the disclosed subject matter, systems, methods, and a computer readable medium are provided for providing adaptive biofeedback measurement and stimulation.

Disclosed subject matter includes, in one aspect, a method for providing physiological stimulation. The method includes, in step (a), receiving, at a computing device, sensory data associated with at least an action of a first user from a sensor. The method includes, in step (b), generating, at the computing device, a command signal based on (1) the sensory data and (2) a command signal classifier. The method includes, in step (c), sending, at the computing device, the command signal to an actuator, wherein the command signal is used to control motions of the actuator. The method includes, in step (d), receiving, at the computing device, updated sensory data from the sensor based on the motions of the actuator. The method includes, in step (e), determining, at the computing device, whether the updated sensory data have reached a predetermined threshold. If the sensory data have not reached the predetermined threshold: generating, at the computing device, an updated command signal based on (1) the updated sensory data and (2) the command signal classifier; sending, at computing device, the updated command signal to the actuator, wherein the updated command signal is used to control motions of the actuator; and repeating, at the computing device, steps (d) to (e) until the updated sensory data have reached the predetermined threshold.

Disclosed subject matter includes, in another aspect, an apparatus for providing physiological stimulation in the following steps. The apparatus includes a sensor configured to sense data associated with at least an action of a first user. The apparatus includes an actuator configured to generate motions. The apparatus includes a controller, coupled to the sensor and the actuator, configured to run a module stored in memory that is configured to cause the processor to do the following steps. In step (a), the controller receives sensory data from the sensor. In step (b), the controller generates a command signal based on (1) the sensory data and (2) a command signal classifier. In step (c), the controller sends the command signal to an actuator, wherein the command signal is used to control motions of the actuator. In step (d), the controller receives updated sensory data from the sensor based on the motions of the actuator. In step (e), the controller determines whether the updated sensory data have reached a predetermined threshold. If the sensory data have not reached the predetermined threshold: the controller generates an updated command signal based on (1) the updated sensory data and (2) the command signal classifier; the controller sends the updated command signal to the actuator, wherein the updated command signal is used to control motions of the actuator; and the controller repeats steps (d) to (e) until the updated sensory data have reached the predetermined threshold.

Disclosed subject matter includes, in yet another aspect, a non-transitory computer readable medium. The non-transitory computer readable medium comprises executable instructions operable to cause an apparatus to, in step (a), receive sensory data from the sensor. The instructions are further operable to cause the apparatus to, in step (b), generate a command signal based on (1) the sensory data and (2) a command signal classifier. The instructions are further operable to cause the apparatus to, in step (c), send the command signal to an actuator, wherein the command signal is used to control motions of the actuator. The instructions are further operable to cause the apparatus to, in step (d), receive updated sensory data from the sensor based on the motions of the actuator. The instructions are further operable to cause the apparatus to, in step (e), determine whether the updated sensory data have reached a predetermined threshold. If the sensory data have not reached the predetermined threshold, the instructions are further operable to cause the apparatus to: generate an updated command signal based on (1) the updated sensory data and (2) the command signal classifier; send the updated command signal to the actuator, wherein the updated command signal is used to control motions of the actuator; and repeat steps (d) to (e) until the updated sensory data have reached the predetermined threshold.

Before explaining example embodiments consistent with the present disclosure in detail, it is to be understood that the disclosure is not limited in its application to the details of constructions and to the arrangements set forth in the following description or illustrated in the drawings. The disclosure is capable of embodiments in addition to those described and is capable of being practiced and carried out in various ways. Also, it is to be understood that the phraseology and terminology employed herein, as well as in the abstract, are for the purpose of description and should not be regarded as limiting.

These and other capabilities of embodiments of the disclosed subject matter will be more fully understood after a review of the following figures, detailed description, and claims.

It is to be understood that both the foregoing general description and the following detailed description are explanatory only and are not restrictive of the claimed subject matter.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION OF THE INVENTION

Figure 1:
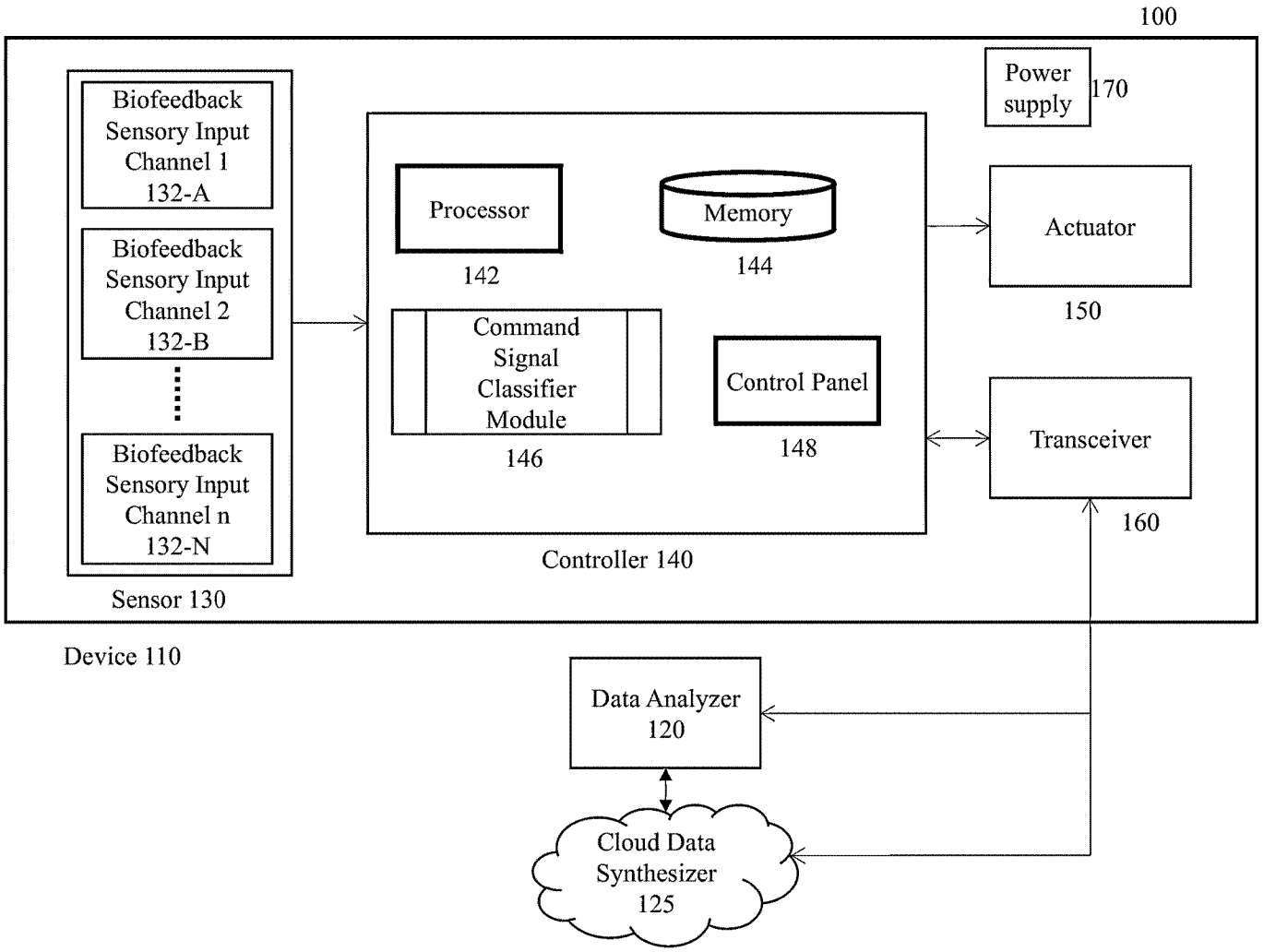
FIG. 1 illustrates a block diagram of a system for providing adaptive biofeedback measurement and stimulation in accordance with an embodiment of the disclosed subject matter.

In the following description, numerous specific details are set forth regarding the systems and methods of the disclosed subject matter and the environment in which such systems and methods may operate, etc., in order to provide a thorough understanding of the disclosed subject matter. It will be apparent to one skilled in the art, however, that the disclosed subject matter may be practiced without such specific details, and that certain features, which are well-known in the art, are not described in detail in order to avoid complication of the disclosed subject matter. In addition, it will be understood that the examples provided below are exemplary, and that it is contemplated that there are other systems and methods that are within the scope of the disclosed subject matter.

The present invention is directed to a physiological measurement and stimulation device and method that can autonomously adapt its actuation output behavior based on acquired data in the form of biofeedback sensory measurements. The invention can be applied to any suitable device, including, for example, as a sexual stimulation device, a body massager and relaxation device, or a biofeedback data acquisition and processing software platform. While the invention is primarily described in the context of a sexual stimulation device, the invention also applies to any other suitable device as identified above.

The external physical appearance of the invention can be of similar shape to existing consumer vibrators, body massagers, or relaxation devices. Functionally, the invention can include one or more of the following components: one or more on-board physiological measurement sensors, biofeedback sensory data from connected off-board physiological measurement sensors, a user-operated control panel, one or more actuators, a power source, an electronics module/controller, and one or more off-board devices such as a data analyzer.

When operating the invention, the user can place the device on the body at the intended area of operation, at which time the physiological measurements sensors can initiate data collection. Either prior to or following this time, the actuator can be activated and controlled manually and/or autonomously per a command signal generated by the control system. The sensor, the actuator, and other components of the invention can form a feedback loop: the actuator adapts its motions based on the data collected by the sensor, and the sensor collects new data based on the updated motions of the actuator. In some embodiments, the operation of the present invention can be continued until the invention detects that a predetermined threshold has been reached. When the invention is used as a sexual stimulation device, the predetermined threshold can be physiological data corresponding to various stages of arousal or orgasm.

The present invention is different from the prior art in at least two ways. First, the present invention autonomously controls the device's physical actuation response using biofeedback sensory data collected from the user's body. The present invention does so by incorporating sensor hardware into the design of the device in order to measure physiological responses, for example, heart rate or force from muscular contractions. Conventional devices do not incorporate sensor hardware to measure physiological responses from the user's body, or use such data to control the actuation of the device. Second, the present invention incorporates a learning software functionality in which the device's actuation response continually adapts over time based on accumulated physiological sensor data that is captured over the course of multiple uses. Conventional devices are not capable of non-volatile data capture or a dynamic actuation response that can change with each use.

FIG. 1 illustrates a block diagram of a system 100 for providing adaptive biofeedback measurement and stimulation, according to some embodiments of the disclosed subject matter. The system 100 includes a stimulation device 110, a data analyzer 120, and a cloud data synthesizer 125. The stimulation device 110 can be used by a user internally and/or externally. The data analyzer 120 and the cloud data synthesizer 125 can be located at a different location from the stimulation device 110. In an alternative embodiment, the data analyzer 120 and/or the cloud data synthesizer 125 can be located entirely within, or partially at a different location and partially within, the stimulation device 110. The external physical appearance of the stimulation device 110 can be of similar shape to existing consumer vibrators, body massagers, relaxation devices, or other suitable devices.

Still referring to FIG. 1, the stimulation device 110 includes a sensor 130, a controller 140, an actuator 150, a transceiver 160, and a power supply 170. Components that are located on or inside the stimulation device 110 are also referred to as on-board or local components. Components that are located separated from the stimulation device 110 are also referred to as off-board or remote components. For example, in FIG. 1, the sensor 130, the controller 140, the actuator 150, the transceiver 160, and the power supply 170 are on-board components, whereas the data analyzer 120 and the cloud data synthesizer 125 are off-board components. In some embodiments, certain on-board component or components can be located off-board, and certain off-board component or components can be located on-board. For example, in some embodiments, the controller 140 and/or one or more sensors 130 can be located off-board. In some embodiments, the data analyzer 120 and/or the cloud data synthesizer can be located on-board. The components illustrated in FIG. 1 can be further broken down into more than one component and/or combined together in any suitable arrangement. Further, one or more components can be rearranged, changed, added, and/or removed. For example, in some embodiments, the system 100 may only include the data analyzer 120 but not the cloud data synthesizer 125. The data analyzer 120 may alternatively or additionally implement the functionality of the cloud data synthesizer 125. In some embodiments, the system 100 may only include the cloud data synthesizer 125 but not the data analyzer 120. The cloud data synthesizer 125 may alternatively or additionally implement the functionality of the data analyzer 120.

Referring now to the sensor 130, the sensor 130 senses sensory data from human body and sends the sensory data to the controller 140. In some embodiments, the sensory 130 can also send the sensory data to the data analyzer 120 and/or the cloud data synthesizer 125. The sensory data sensed by the sensor 110 can be data associated with least an action of a user, including biofeedback sensory measurements associated with the user. Examples of specific sensory data can include, but are not limited to, force exerted against the surface of the device 110 by an external environment such as the user; moisture level of the external environment; surface temperature of the device 110; the user's heart rate; position, velocity, and/or acceleration of the device 110; or any other suitable measurement or combination of measurements. In some embodiments, the sensor 130 can collect more than one type of data. As shown in FIG. 1, the sensor 130 can include multiple biofeedback sensory input channels 132-A through 132-N (collectively referred to herein as channel 132). Each channel 132 can be configured to sense and/or output one or more types of sensory data. As a non-limiting example, in some embodiments, the sensor 130 can include four biofeedback sensory input channels 132-A, 132-B, 132-C, and 132-D, where the channel 132-A senses and outputs the user's heart rate, the channel 132-B senses and outputs the user's temperature, the channel 132-C senses and outputs force exerted against the surface of the device 110 (for example, force can be vaginal muscle contractions from the user's body), and the channel 132-D senses and outputs the velocity of the device 110.

In some embodiments, the device 110 can include more than one sensor 130. As a non-limiting example, the device 110 can include a first sensor sensing the user's temperature and a second sensor sensing the user's heart rate. Further, some or all of the sensors included in the system 100 can be located off-board.

The sensor 130 can also use any commercially available sensors, including, without limitation, force-resistive sensors, strain gauges, barometric pressure sensors, capacitive sensors, thermocouple sensors, infrared sensors, resistive and capacitive moisture sensors, and any other suitable sensors or combination of sensors.

Referring now to the controller 140, the controller receives sensory data from the sensor 130 and generates a command signal or command signals to the actuator 150. As shown in FIG. 1, the controller 140 can include a processor 142, memory 144, a command signal classifier module 146, and a control panel 148. Although the memory 144 and the command signal classifier module 146 are shown as separate components, the command signal classifier module 146 can be part of the memory 144. The processor 142 or the controller 140 may include additional modules, less modules, or any other suitable combination of modules that perform any suitable operation or combination of operations.

The processor 142 can be configured to implement the functionality described herein using computer executable instructions stored in temporary and/or permanent non-transitory memory. In some embodiments, the processor 142 can be configured to run a module stored in the memory 144 that is configured to cause the processor 142 to do the following steps. In step (a), the processor 142 receives sensory data from the sensor. In step (b), the processor 142 generates a command signal based on (1) the sensory data and (2) a command signal classifier. In step (c), the processor 142 sends the command signal to the actuator 150, wherein the command signal is used to control the motions of the actuator 150. In step (d), the processor 142 receives updated sensory data from the sensor 130 based on the motions of the actuator 150. In step (e), the processor 142 determines whether the updated sensory data have reached a predetermined threshold; and if the sensory data have not reached the predetermined threshold, the processor 142 does the following: generating an updated command signal based on (1) the updated sensory data and (2) the command signal classifier; sending the updated command signal to the actuator, wherein the updated command signal is used to control motions of the actuator; and repeating steps (d) to (e) until the updated sensory data have reached the predetermined threshold. The processor 142 can be a general purpose processor and/or can also be implemented using an application specific integrated circuit (ASIC), programmable logic array (PLA), field programmable gate array (FPGA), and/or any other integrated circuit. For example, the processor 142 can be an on-board microprocessor having architectures used by AVR, ARM, Intel, or any other microprocessor manufacturers. In some embodiments, the function of the processor 142 can be implemented using other component of the controller 140, the controller 140, the data analyzer 120, the cloud data synthesizer 125 and/or any other set of suitable components.

The processor 142 can execute an operating system (OS) that can be any suitable operating system, including a typical operating system such as Windows, Windows XP, Windows 7, Windows 8, Windows Mobile, Windows Phone, Windows RT, Mac OS X, Linux, VXWorks, Android, Blackberry OS, iOS, Symbian, or other OS.

In some embodiments, the processor 142 can further include one or more components. As a non-limiting example, the processor 142 can include a signal processing unit and a control system. The signal processing unit can convert the sensory data sent from the sensor 130 into a format recognizable by the system 100. The signal processing unit can include an analog to digital conversion module that can convert analog sensory data from the sensor 130 into a digital format readable by the processor 142 or other microcontrollers. The signal processing unit can additionally include an algorithm that can translate raw digital sensor data into standard units of measurement, such as heart rate in beats per minute, temperature in Fahrenheit or Celsius, or any other suitable measurement. The signal processing unit can also associate the sensory data with discrete timestamps. The processed sensory data can then be sent to the control system, the memory 144, the data analyzer 120, and/or the cloud data synthesizer 125.

The control system can generate command signals based on the sensory data from the sensor 130 (and/or the processed sensory data from the signal processing unit) and a command signal classifier, which can be a command signal classification algorithm. The command signals can be electrical signals (for example, electrical current and/or electrical voltage), hydraulic liquid pressure, or any other suitable energy forms. The command signals are used to control motions of the actuator 150. In some embodiments, the actuator 150 can be a vibrator, and the command signals can control the intensity, position, velocity, acceleration, and/or any other suitable features or combination of features of the vibration generated by the vibrator. The command signal classifier can be maintained by the command signal classifier module 146 or other modules of the controller 140. The command signals can also be associated with discrete timestamps and sent to the memory 144, the data analyzer 120, and/or the cloud data synthesizer 125. In some embodiments, the control system can include a microcontroller chip as well as a digital to analog conversion module that can convert digital command signal data into an analog voltage, which in turn can power the actuator 150.

The command signal classifier module 146 maintains the command signal classifier. The command signal classifier controls a transfer function between the sensory data and the command signal. The command signal classifier can be a linear function or a non-linear function. In some embodiments, the command signal classifier can be updated in real-time using machine learning techniques or any other suitable techniques. In some embodiments, the command signal classifier can be updated at any given time via a firmware update. The updated version of the command signal classifier can be sent from the data analyzer 120 and/or the cloud data synthesizer 125 via the transceiver 160.

In some embodiments, the command signals and the command signal classifier also depend on one or more of the following: population data, past individual data, and user setting. The population data are related to various data collected from other users and can be used as a baseline for the command signal classifier. For example, when the device 110 is used as a sexual stimulation device for women, the population data can indicate generally how people react to a certain intensity of vibration, including how soon, on average, users reach various stages of arousal and orgasm. Although the population data may not necessarily represent a particular user's experience, the command signal classifier can adapt to the user's physiological characteristics based on the population data. The device 110 can retrieve the population data from the memory 144, the control panel 148, the data analyzer 120, and/or the cloud data synthesizer 125.

The past individual data are related to past data related to a particular user. In some embodiments, the command signal classifier can use the past individual data to facilitate the detection of certain trends and patterns of the user. For example, if the past individual data suggests that the user reacts strongly to a certain range of vibration frequency, the command signal classifier may adapt accordingly and general command signals that cause the actuator 150 to vibrate near that frequency. The device 110 can retrieve the past individual data from the memory 144, the control panel 148, the data analyzer 120, and/or the cloud data synthesizer 125.

The user setting is related to certain settings selected by the user or detected by the device 110. As non-limiting examples, the user setting can include physiological data of the user, such as the user's menstrual cycle and intensity level of the actuator 150. As an example, the user may reach various stages of arousal and orgasm faster or slower depending on the user's menstrual cycle. As another example, the user may only react well to a high-intensity level of vibration or a low-intensity level of vibration. The command signal classifier can use the user setting to generate command signals that cause motions more suitable for the user. The device 110 can retrieve the user setting from the memory 144, the control panel 148, the data analyzer 120, and/or the cloud data synthesizer 125.

When the device 110 also receives the population data, past individual data, and/or the user setting, the processor 142 or its signal processing unit can process the data together with the sensory data.

The command signal classifier module 230 can be implemented in software using the memory 144. The memory 144 can be a non-transitory computer readable medium, flash memory, a magnetic disk drive, an optical drive, a programmable read-only memory (PROM), a read-only memory (ROM), or any other memory or combination of memories.

The memory 144 can also be used to as internal data storage for the device 110. During the operation of the device 110, the memory 144 can store data such as the sensory data, the population data, the past individual data, the user setting, the command signals, and any data that are processed by the system 100. In some embodiments, the memory 144 can also synchronize the stored data with the data analyzer 120 and/or the cloud data synthesizer 125 in real time or at a later time when a communication connection is established between the device 110 and the off-board components via the transceiver 160.

The control panel 148 can be used by the user to enter various instructions and data. In some embodiments, the user can use the control panel 148 to turn the system 100 on or off. In some embodiments, the user can use the control panel 148 to manually input the population data, the past individual data, the user setting, and/or other parameters can be used by the processor 142 or the command signal classifier module 146. The control panel 148 can include a display screen for viewing output. In some embodiments, the control panel 148 can also provide a variety of user interfaces such as a keyboard, a touch screen, a trackball, a touch pad, a mouse and/or any other suitable interface or combination of interfaces. The control panel 148 may also include speakers and a display device in some embodiments.

Referring now to the actuator 150, the actuator 150 receives the command signal from the controller 140 and generates motions such as vibrations. The command signal can be an electrical signal (for example, electrical current and/or electrical voltage), hydraulic liquid pressure, or any other suitable energy forms. The actuator 150 converts the command signal into motions and can change the intensity of the motions based on the variance of the command signal. The relations between the command signal and the intensity of the motions of the actuator 150 can be linear, nonlinear, or any suitable combination thereof. As non-limiting examples, the actuator 150 can be a vibrating motor, an array of vibrating motors, a piezoelectric motor, or any suitable types of motors and/or actuators that can convert the command signal into motions.

Figure 7:
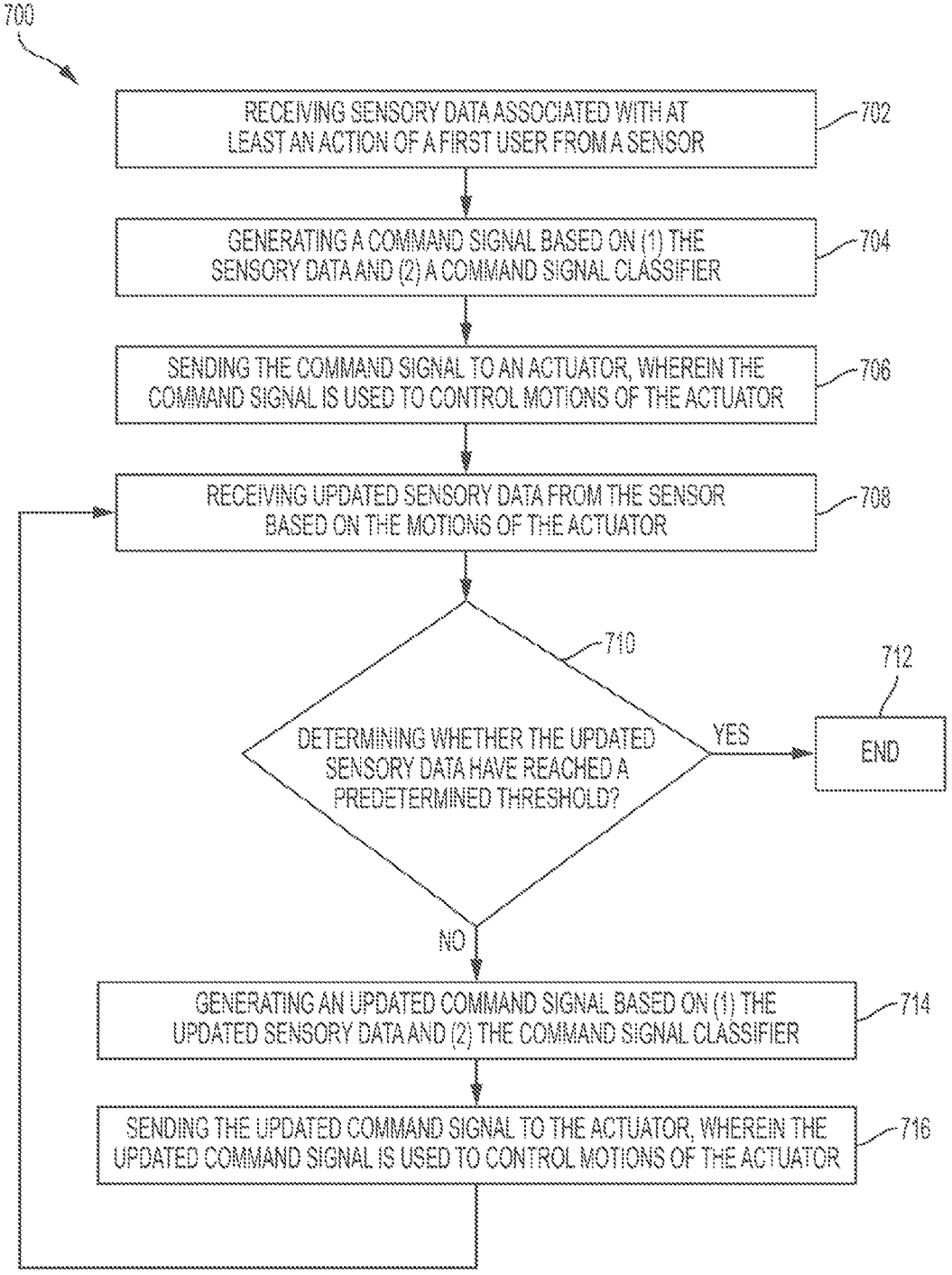
FIG. 7 is a flow diagram illustrating a process for dynamically generating command signals and other information in accordance with an embodiment of the disclosed subject matter.

FIG. 7 is a flow diagram illustrating a feedback loop process 700 for dynamically generating command signals and other information. The process 700 can be modified by, for example, having steps rearranged, changed, added, and/or removed.

In step 702, the sensor 130 senses sensory data associated with at least an action of the user or the user's body. The sensor 130 then sends the sensory data to the controller 140. As discussed earlier, examples of specific sensory data can include, without limitation, force exerted against the surface of the device 110 by an external environment such as the user; moisture level of the external environment; surface temperature of the device 110; the user's heart rate; position, velocity, and/or acceleration of the device 110; or any other suitable measurement or combination of measurements. The process 700 then proceeds to step 704

In step 704, the controller 140 generates the command signal based on the sensory data received from the sensor 130 and the command signal classifier. In some embodiments, the generation of the command signal can be additionally based on the user setting, the population data, and/or the past individual data. As discussed earlier, the command signal can be an electrical signal (for example, electrical current and/or electrical voltage), hydraulic liquid pressure, or any other suitable energy forms. In some embodiments, the controller 140 can also update the command signal classifier based on the, the sensory data, the user setting, the population data, and/or the past individual data. The process 700 then proceeds to step 706.

In step 706, the controller 140 sends the command signal to the actuator 150, and the actuator 150 adapts its motions based on the command signal. For example, when the control signal varies, the actuator 150 can change the intensity, velocity, orientation, direction, position, or acceleration of the motions generated. The process 700 then proceeds to step 708.

In step 708, the sensor 130 again senses sensory data associated with at least an action of the user or the user's body. The sensory data sensed are updated sensory data because they can respond to any change of the motions of the actuator 150 or any change of the user's physiological data caused by the change of the motions of the actuator 150. The sensor 130 then sends the updated sensory data to the controller 140. The process 700 then proceeds to step 710.

In step 710, the controller 140 determines whether the updated sensory data received from the sensor 130 reach the predetermined threshold. As discussed earlier, when the invention is used as a sexual stimulation device, the predetermined threshold can be physiological data corresponding to various stages of arousal or orgasm. As a non-limiting example, when the user reaches an orgasm, the user's certain physiological data, such as vaginal muscle contractions, heart rate, and/or body temperature may reach respective threshold values. If the controller 140 determines that the updated sensory data reach the predetermined threshold, the process 700 proceeds to step 712. If the controller 140 determines that the updated sensory data do not reach the predetermined threshold, the process 700 proceeds to step 714.

In step 712, the controller 140 has determined that the updated sensory data reached the predetermined threshold. In some embodiments, the device 110 can keep the motions of the actuator 150 for a period of time automatically set by the device 110 or manually selected by the user. In some embodiments, the process 700 concludes in step 714. In some embodiments, the process 700 may return to step 702 or step 710 immediately or after the period of time.

In step 714, the controller 140 generates the updated command signal based on the updated sensory data received from the sensor 130 and the command signal classifier. In some embodiments, the generation of the command signal can be additionally based on the user setting, the population data, and/or the past individual data. In some embodiments, the controller 140 can also update the command signal classifier based on the updated sensory data, the sensory data, the user setting, the population data, and/or the past individual data. The process 700 then proceeds to step 716.

In step 716, the controller 140 sends the updated command signal to the actuator 150, and the actuator 150 adapts its motions based on the updated command signal. The process 700 then returns to step 708.

Referring now to the transceiver 160, the transceiver 160 can represent a communication interface between the device 110 and off-board component(s), such as the data analyzer 120 and the cloud data synthesizer 125. The transceiver 160 enables bidirectional communication between the device 110 and off-board component(s) via any wired connection including, without limitation, universal serial bus standard (USB) and Ethernet, and/or any wireless connection including, without limitation, Bluetooth, WiFi, cellular and other wireless standards. In some embodiments, transceiver can also enable bidirectional communication between the device 110 and off-board component(s) via a network. As non-limiting examples, the network can include the Internet, a cellular network, a telephone network, a computer network, a packet switching network, a line switching network, a local area network (LAN), a wide area network (WAN), a personal area network (PAN), a metropolitan area network (MAN), a global area network, or any number of private networks currently referred to as an Intranet, or any other network or combination of networks that can accommodate data communication. Such a network may be implemented with any number of hardware and/or software components, transmission media and/or network protocols. The transceiver 160 can be implemented in hardware to send and receive signals in a variety of mediums, such as optical, copper, and wireless, and in a number of different protocols some of which may be non-transient. The transceiver 160 can be on-board or off-board. Although FIG. 1 illustrates the system 100 has a single transceiver 160, the system 100 can include multiple transceivers. In some embodiments, if the system 100 includes multiple transceivers 150, some transceiver(s) can be located on-board, and some transceiver(s) can be located off-board.

Referring now to the power supply 170, the power supply 170 provides power to the on-board components, such as the sensor 130, the controller 140, the actuator 150, and the transceiver 160. In some embodiments, the power supply 170 can be a battery source. In some embodiments, the power supply 170 can provide alternating-current (AC) or direct-current (DC) power via an external power source. The power supply 170 is preferably located on-board the device 110, but can also be located off-board.

Referring now to the data analyzer 120, the data analyzer 120 can receive sensory data, command signals, and/or other user data (collectively the user data) from the on-board components such as the sensor 130, the controller 140, and/or the actuator 150 via the transceiver 160. The data analyzer 120 can use the user data to detect certain trends and patterns such as various stages of arousal or orgasm, and can recommend an improved command signal classifier that can be autonomously or manually uploaded to the controller 140. In some embodiments, the data analyzer 120 can provide self-report and insight report to the user. The self-report can analyze any data collected during the operation of the system 100 and report the user's information or activities in different types of event. The insight report can analyze any data collected during the operation of the system 100 and report items such as how frequent the user has reached orgasm using the system 100. In some embodiments, the data analyzer 120 can send the population data, the past individual data, and/or the user setting to the device 110. As a non-limiting example, the controller 140 can receive a new command signal classifier from the data analyzer 120 through the transceiver, and the new command signal classifier can replace the existing command signal classifier through a firmware upgrade. In some embodiments, the data analyzer 120 can be configured to periodically connect to the cloud data synthesizer 125 to upload accumulated user data and to download updates to the command signal classifier.

The data analyzer 120 may be implemented in hardware, software, or any suitable combination thereof. In some embodiments, the data analyzer can include a software application installed on a user equipment. The user equipment can be a mobile phone having phonetic communication capabilities. The user equipment can also be a smartphone providing services such as word processing, web browsing, gaming, e-book capabilities, an operating system, and a full keyboard. The user equipment can also be a tablet computer providing network access and most of the services provided by a smartphone. The user equipment operates using an operating system such as Symbian OS, iPhone OS, RIM's Blackberry, Windows Mobile, Linux, HP WebOS, and Android. The user equipment may also include a touch screen that is used to input data to the mobile device, in which case the screen can be used in addition to, or instead of, the full keyboard. The user equipment can also keep global positioning coordinates, profile information, or other location information.

In some embodiments, the user equipment may also include any platforms capable of computations and communication. Non-limiting examples can include televisions (TVs), video projectors, set-top boxes or set-top units, digital video recorders (DVR), computers, netbooks, laptops, and any other audio/visual equipment with computational capabilities. The user can be configured with one or more processors that process instructions and run software that may be stored in memory. The processor also communicates with the memory and interfaces to communicate with other devices. The processor can be any applicable processor such as a system-on-a-chip that combines a CPU, an application processor, and flash memory. The user device 106 can also provide a variety of user interfaces such as a keyboard, a touch screen, a trackball, a touch pad, and/or a mouse. The user equipment may also include speakers and a display device in some embodiments.

Referring to the cloud data synthesizer 125, in some embodiments, the system 100 can also include the cloud data synthesizer 125. In some embodiments, the data analyzer 120 can be additionally used to anonymously and securely connect to the cloud data synthesizer 125 to upload user data and download improved and/or updated command signal classifier. When the data analyzer 120 securely connects to the cloud data synthesizer 125, the data analyzer 120 can either preprocess the user data (e.g., generation of some analysis of the user data or transformation of the user data) before uploading to the cloud data synthesizer 125, or upload the user data directly to the cloud data synthesizer 125 without preprocessing the data. The cloud data synthesizer 125 can then use the user data uploaded from the data analyzer 120 to detect trends and patterns and recommend improved command signal classifier that can then be downloaded to the data analyzer 120 for eventual transmission to the device 110. The cloud data synthesizer 125 can include software residing off-board on a cloud server.

In some embodiments, the cloud data synthesizer 125 can be used to connect to the data analyzer 120 to aggregate data from multiple users to generate an improved command signal classifier. When used in this manner, the data analyzer 120 may or may not preprocess each user's data before uploading to the cloud data synthesizer 125. The improved command signal classifier can then be downloaded to the data analyzer 120 from the cloud data synthesizer 125 for eventual transmission to the device 110. In some embodiments, the cloud data synthesizer 125 can send the population data, the past individual data, and/or the user setting to the device 110.

In some embodiments, the cloud data synthesizer 125 can directly communicate with the device 110 via the transceiver 160. For example, the cloud data synthesizer 125 can receive user data from the on-board components. The cloud data synthesizer 125 can use the user data to detect certain trends and patterns, and can recommend an improved command signal classifier that can be autonomously or manually uploaded to the controller 140.

In some embodiments, the device 110 can transmit various user data to the data analyzer in real-time. In some embodiments, the device 110 can wait until the conclusion of device operation before attempting to connect to the data analyzer 120 in order to transmit accumulated user data from the memory 144. In some embodiments, the accumulated user data can be viewed by user equipment that is connected to the data analyzer. In the event that the device 110 is unable to connect to the data analyzer 120, the device 110 can be configured to shut down until such time that the user once again renders it operational. In the event that the device 110 does successfully connect to the data analyzer 120, the device can upload all or some subsets of the user data contained in the memory 144, after which the uploaded user data can be maintained or erased from the memory 144. Subsequently, the data analyzer 120 can upload any updates to the command signal classifier, or other suitable updates, to the device 110. Additionally, the user can manually establish a connection between the data analyzer 120 (or the cloud data synthesizer 125) and the device 110.

In some embodiments, all components on-board the device 110 are of acceptable size, weight, and power consumption to be integrated within the device 110. For example, the device 110 can measure approximately one inch in diameter and five inches in length, or any other suitable dimensions having a smaller or larger diameter and/or length. In some embodiments, the controller 140, the transceiver 160, and/or the power supply 170 are of acceptable size to be integrated onto a single printed circuit board. In some embodiments, the sensor 130 and the actuator 150 are connected to the controller 140, the transceiver 160, and/or the power supply 170 via conductive material.

Figure 2:
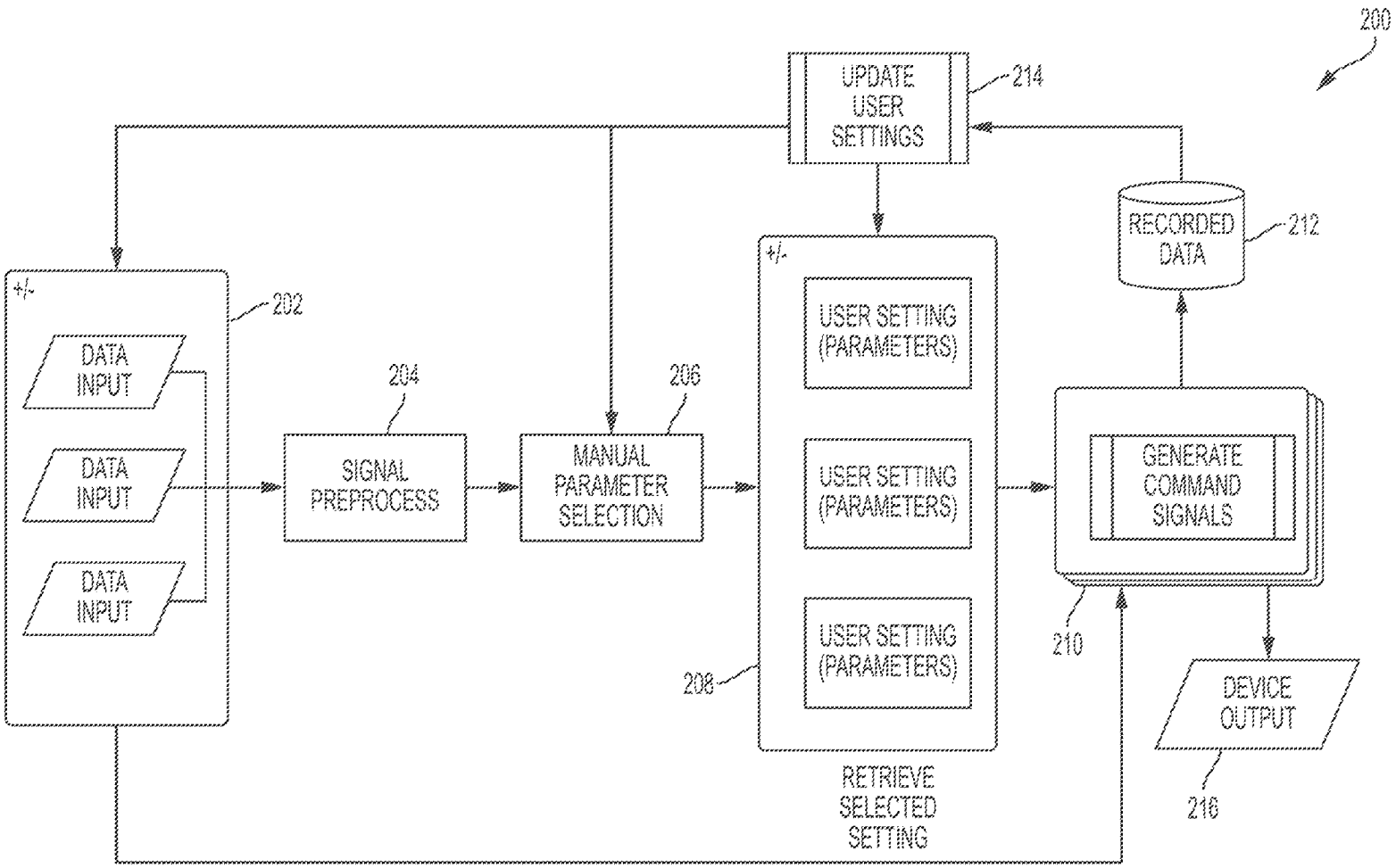
FIG. 2 is a flow diagram illustrating a process for dynamically generating command signals and other information in accordance with an embodiment of the disclosed subject matter.

FIG. 2 is a flow diagram illustrating a process 200 for dynamically generating command signals and other information. The process 200 can be iterative and run until some suitable end-state is reached, which can be, but is not limited to, an orgasm. The process 200 can be modified by, for example, having steps rearranged, changed, added, and/or removed. In some embodiments, the process 200 can be implemented by controller 140: the command signal classifier module 146 and/or other modules are configured to cause the processor 142 to achieve the functionality described herein. Although the process 200 is illustrated below in connection with the controller 140, the process 200 can be implemented using other component of the controller 140 such as the processor 142, the data analyzer 120, the cloud data synthesizer 125 and/or any other set of suitable components.

In step 202, the controller 140 receives the sensory data from the sensor 130. In some embodiments, the controller 140 can additionally or alternatively receive the population data, the past individual data, and/or the user setting from the memory 144, the control panel 148, the data analyzer 120, and/or the cloud data synthesizer 125. The sensory data, the population data, the past individual data, and the user setting are collectively referred to as input data, and they can be used in other steps of the process 200.

In step 204, the controller 140 converts input data received from step 202 into a format recognizable by the system 100. As discussed earlier, in some embodiments, this step can be implemented by a signal processing unit included in the processor 142. The signal processing unit can include an analog to digital conversion module that can convert analog input data into a digital format readable by a microcontroller. The signal processing unit can additionally include an algorithm that can translate raw digital input data into standard units of measurement, such as heart rate in beats per minute, temperature in Fahrenheit or Celsius, or any other suitable measurement. The processed input data can be associated with discrete timestamps. In some embodiments, step 204 can be additionally or alternatively handled by other components of controller 140 and/or the processor 142. The process 200 then proceeds to step 206.

In step 206, the controller 140 determines some or all parameters used by the command signal classifier based on the user setting. As a non-limiting example, the parameters can include various coefficients such as an amplification gain used to convert the sensory data into the command signals. In some embodiments, the user can manually specify certain parameters in the user settings via the control panel 148, the data analyzer 120, or the cloud data synthesizer 125, and these parameters can be incorporated by the controller 140 in step 206. The parameters determined in step 206 can also be updated in step 214. The process 200 then proceeds to step 208.

In step 208, the controller 140 determines additional parameters used by the command signal based on the input data. The additional parameters determined in step 208 are the parameters not manually specified by the user in step 206. If the user does not manually specify any parameter, the controller 140 can determine all parameters used by the command signal classifier in step 208. If the user manually specifies all parameters used by the command signal classifier, step 208 can be bypassed. In some embodiments, the parameters are fixed or can be selected from a set of pre-calculated data. In some embodiments, the parameters can be dynamically calculated by employing certain machine learning techniques such as K-Means, support vector machines, or any other suitable clustering or classification algorithms. The parameters determined in step 206 can also be updated in step 214. The process 200 then proceeds to step 210.

In step 210, the controller 140 can be configured to evaluate/measure the sensory data and generate output signals for other components of the system 100. The output signals include the command signals for the actuator 150. In some embodiments, the output signals also include quantified measurements, user's physiological characteristics, and/or various feedback used to update or improve the command signal classifier. Step 210 is described in more detail in connection with FIG. 3 below. The process 200 then proceeds to step 212 and 216

In step 212, the controller 140 send the data generated in the process 200 to the memory 144 for storage and/or further analysis. Some of the data will be used for further iteration of the process 200. The process 200 then proceeds to step 214.

In step 214, the controller 140 is configured to update the parameters used by the command signal classifier or other components of the system 100. The updated parameters can be incorporated in the step 206 and 208 as the process 200 iterates. Step 214 is described in more detail in connection with FIG. 4 below. The process 200 then proceeds to step 202 to re-iterate.

In step 216, the controller 140 sends the command signals to the actuator 150. In some embodiments, the controller 140 can further send the command signals and/or other data from the process 200 to the data analyzer 120, and/or the cloud data synthesizer 125.

It is to be understood that any of the steps described in FIG. 2 can be executed on-board or off-board the physical embodiment of the invention. As an example, some or all steps of the process 200 can be implemented within the outlined internal layout of the device in FIG. 5 (discussed below) or can be executed separately from, and passed to, a remote device.

Figure 3:
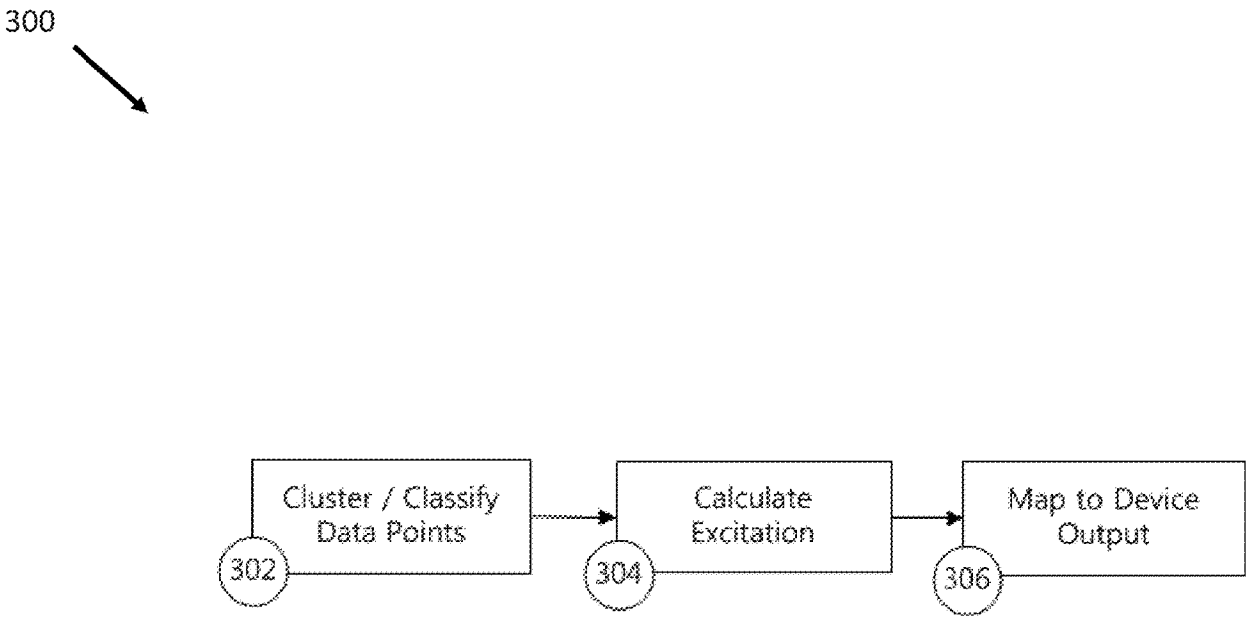
FIG. 3 is a flow diagram illustrating a process for mapping user data and the command signals in accordance with an embodiment of the disclosed subject matter.

FIG. 3 is a flow diagram illustrating a process 300 that implements step 210 of the process 200, according to some embodiments of the disclosed subject matter. The process 300 can be modified by, for example, having steps rearranged, changed, added, and/or removed. For example, in some embodiments, step 302 can be moved to the process 400 as step 402. In some embodiments, both step 302 and step 402 can be bypassed, and the controller 140 assumes all users have the same physiological characteristics. Although the process 300 is illustrated below in connection with the controller 140, the process 300 can be implemented using other component of the controller 140 such as the processor 142, the data analyzer 120, the cloud data synthesizer 125 and/or any other set of suitable components.

In step 302, the controller 140 can be configured to use any combination or subset of the input data received in step 202 or the processed input data generated in step 204 to generate a cluster of the input data. The cluster of the input data can be any suitable partitions of the input data. For example, the partition of the input data can be done using, but is not limited to, machine learning techniques such as K-Means, support vector machines, or any other suitable clustering or classification algorithm or algorithms. In some embodiments, the sensory data and/or the cluster of the input data can be used to identify certain physiological characteristics of the user. For example, based on the sensory data and/or the cluster of the input data, the controller 140 can be configured to identify the type or types of orgasm the user may have. When the device 110 is used as a sexual stimulation device, the correct identification of the type(s) of arousal or orgasm is important to avoid misinterpreting the sensory data, because the same set of sensory data may be interpreted as different physiological processes and/or body reaction for different types of arousal or orgasm. The process 300 then proceeds to step 304.

In step 304, the controller 140 can be configured to utilize input data received in step 202 or the processed input data from step 204 to generate a quantified measure of physiological excitation. In some embodiments, the physiological excitation can be sexual excitation. The sexual excitation measure can determine how close the user is to orgasm by comparing the sensor data with prior sensor data. As a non-limiting example, the quantified measure can take the form of a linear mapping from the sensor 130 to a single number or multiple numbers that are comparable across multiple iterations of the step 304 with the same or different inputs. In some embodiments, the sexual excitation measure can be used directly as a quantified measure or mapped to a single or multiple numbers to generate a more suitable quantified measure. In some embodiments, this sexual excitation measure can also incorporate knowledge of physiology and/or the user's physiological characteristics identified in step 302 and/or step 402. For example, assuming, for a typical user, a sexual plateau occurs before an orgasm, the controller 140 may interpret certain early sensory data that may otherwise correspond to an orgasm as either an arousal stage or noise. As another example, knowing the user generally is associated with a certain type of orgasm, the controller 140 may interpret the sensory data according to that type of orgasm. As yet another example, knowing the physiological limit of how fast the user's vaginal muscle contractions can occur, the controller 140 may be configured to discard certain sensory data as noise. The process 300 then proceeds to step 306.

In step 306, the controller 140 can be configured to utilize the quantified measure (as a number or multiple numbers) generated in step 304 to create a recognizable and suitable output number or numbers for other components of the device 110, including the command signals for the actuator 150. In some embodiments, the processor 142 can be configured to use a linear mapping between the quantified measure generated in step 304 and the output signals. For example, to generate the command signals, the controller 140 can be configured to normalize the quantified measure obtained in step 304 to a fraction between 0 and 1, and multiply the normalized fraction by a parameter or parameters to obtain command signals in voltage for the actuator 150. In step 306, the controller 140 can also be configured to employ other suitable mathematical transformation to generate suitable output for other components of the system 100.

It is to be understood that any of the steps described in FIG. 3 can be executed on-board or off-board the physical embodiment of the invention. As an example, some or all steps of the process 300 can be implemented within the outlined internal layout of the device in FIG. 5 or can be executed separately from a remote device and passed to the device.

Figure 4:
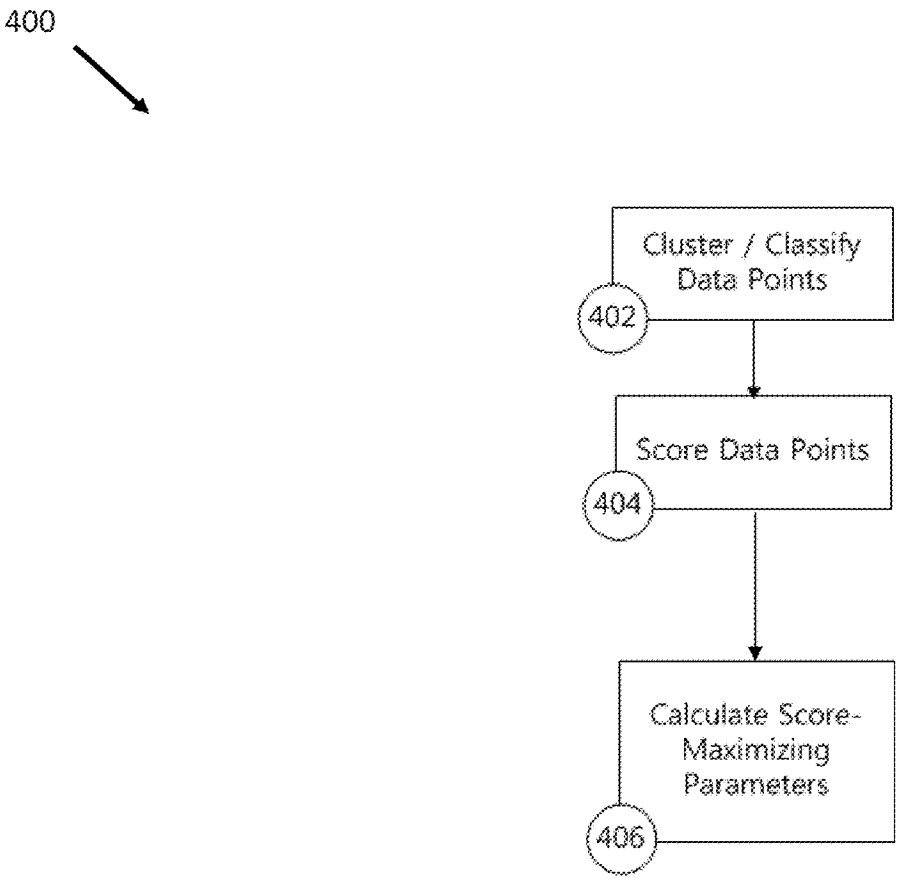
FIG. 4 is a flow diagram illustrating a process for updating parameters used in the command signal classifier in accordance with an embodiment of the disclosed subject matter.

FIG. 4 is a flow diagram illustrating a process 400 that implements step 214 of the process 200, according to some embodiments of the disclosed subject matter. The process 400 can be modified by, for example, having steps rearranged, changed, added, and/or removed. For example, in some embodiments, step 402 may be bypassed if a similar step 302 has been implemented in the process 300. Although the process 400 is illustrated below in connection with the controller 140, the process 400 can be implemented using any component of the controller 140 such as the processor 142, the data analyzer 120, the cloud data synthesizer 125 and/or any other set of suitable components.

In step 402, the controller 140 can be configured to use any combination or subset of the input data received in step 202 or the processed input data generated in step 204 to generate a cluster of the input data. The cluster of the input data can be any suitable partitions of the input data. For example, The partition of the input data can be done using, but is not limited to, machine learning techniques such as K-Means, support vector machines, or any other suitable clustering or classification algorithm or algorithms. In some embodiments, the sensory data and/or the cluster of the input data can be used to identify certain physiological characteristics of the user. For example, based on the sensory data and/or the cluster of the input data, the controller 140 can be configured to identify the type or types of orgasm the user may have. When the device 110 is used as a sexual stimulation device, the correct identification of the type(s) of arousal or orgasm is important to avoid misinterpreting the sensory data, because the same set of sensory data may be interpreted as different physiological processes and/or body reaction for different types of arousal or orgasm. The process 400 then proceeds to step 404.

In step 404, the controller 140 can be configured to calculate a score, from the cluster of input data generated in step 402 and/or step 302, the user's physiological characteristics identified in step 402 and/or step 302, and/or individual input data obtained in step 202, using a prespecified or dynamically determined function. In some embodiments, the score can indicate how close the user is from a predetermined threshold, which can be certain stages of arousal or orgasm. One embodiment of this process can utilize the quantified measure from step 302 to measure how well the device responded to input data given the set of parameters determined in step 206 and/or step 208. The function of the scoring process can be implemented through any number of techniques, including but not limited to a linear map or a maximum likelihood calculation. The score representing desired outcome can be a larger number or smaller number, but for the purposes of this description is assumed to be (but does not need to be) a larger number. In some embodiments, the scoring process can also incorporate knowledge of physiology and/or the user's physiological characteristics identified in step 302 and/or step 402. For example, assuming, for a typical user, a sexual plateau occurs before an orgasm, the controller 140 may interpret certain early sensory data that may otherwise correspond to an orgasm as either an arousal stage or noise. As another example, knowing the user generally is associated with a certain type of orgasm, the controller 140 may interpret the sensory data according to that type of orgasm. As yet another example, knowing the physiological limit of how fast the user's vaginal muscle contractions can occur, the controller 140 may be configured to discard certain sensory data as noise. The process 400 then proceeds to step 406.

In step 406, the controller 140 can be configured to update parameters that can maximize the score determined in step 404. In some embodiments, common numerical techniques like gradient ascent/descent can be used in step 406. The updated parameters can then be passed to step 206 and/or step 208. In some embodiments, step 406 can be implemented on-the-fly when the device 110 is in operation. In some embodiments, step 406 can be implemented offline and can update the firmware of the device 110 before the next operation.

It is to be understood that any of the steps described in FIG. 4 can be executed on-board or off-board the physical embodiment of the invention. As an example, some or all steps of the process 400 can be implemented within the outlined internal layout of the device in FIG. 5 or can be executed separately from a remote device and passed to the device.

Figure 5:
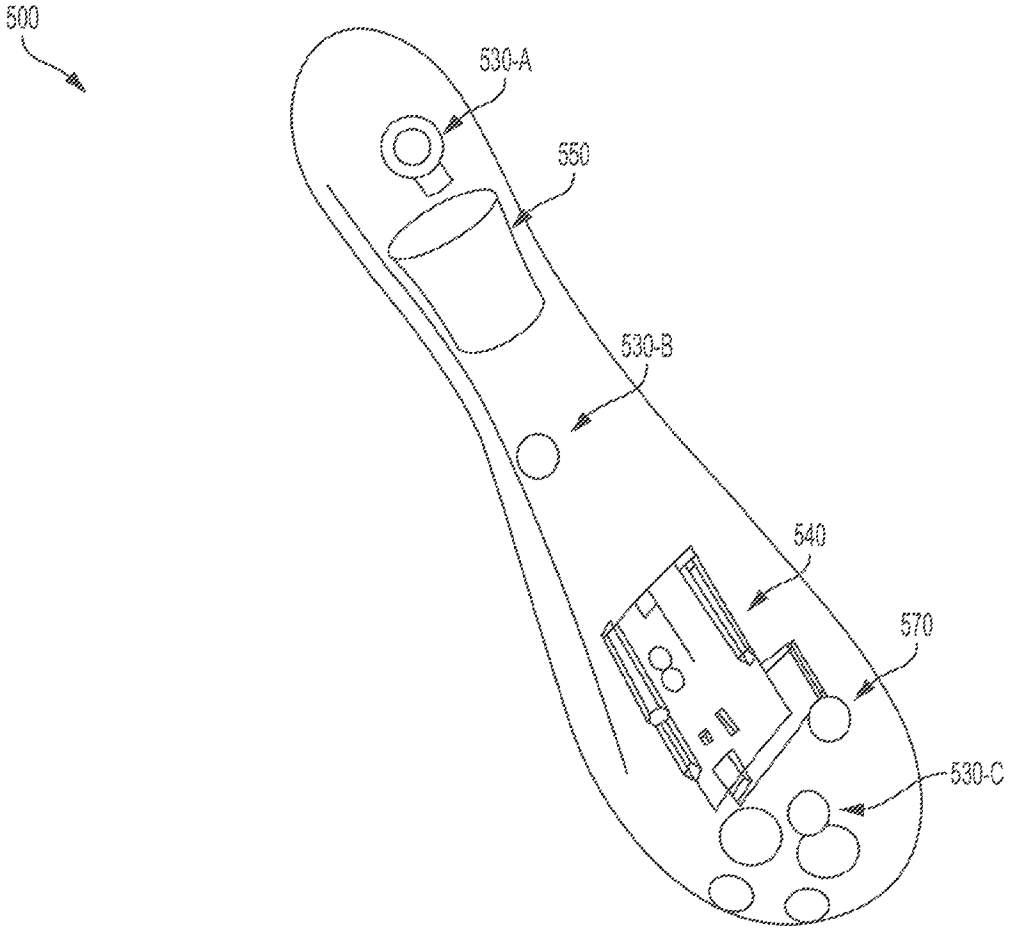
FIG. 5 illustrates a physiological measurement and stimulation device in accordance with an embodiment of the disclosed subject matter.

FIG. 5 illustrates a block diagram of a prototype 500 illustrating the stimulation device 110, according to some embodiments of the disclosed subject matter. As a non-limiting example, the prototype 500 illustrates a form factor shape and internal layout of the device 110. The prototype 500 includes a force sensor 530-A, a temperature sensor 530-B, a heart rate sensor 530-C, an electronic module 540, a vibrating motor 550, and a power unit 570.

The force sensor 530-A can an example of the sensor 130 or one of the biofeedback sensory input channels 132 illustrated in FIG. 1. In some embodiments, the force sensor 530-A can be configured to measure externally exerted force, such as vaginal muscle contractions from the user's body.

The temperature sensor 530-B can be another example of the sensor 130 or one of the biofeedback sensory input channels 132 illustrated in FIG. 1. In some embodiments, the temperature sensor 530-B can be configured to measure body temperature from the user's body.

The heart rate sensor 530-C can be yet another example of the sensor 130 or one of the biofeedback sensory input channels 132 illustrated in FIG. 1. In some embodiments, the heart rate sensor 530-C can be configured to measure heart rate from the user's body.

The electronics module 540 can be an example of the controller 140 and the transceiver 160 illustrated in FIG. 1. In some embodiments, the electronic module 540 can be a printed circuit board that can include the functionality described for the controller 140 and the transceiver 160.

The vibrating motor 550 can be an example of the actuator 150 illustrated in FIG. 1. In some embodiments, the vibrating motor 550 can convert a command voltage signal into a stimulating vibration response onto the user's body.

The power unit 570 can be an example of the power supply 170 illustrated in FIG. 1. In some embodiments, the power unit 570 can be a battery unit that can power the force sensor 530-A, the temperature sensor 530-B, the heart rate sensor 530-C, the electronic module 540, and the vibrating motor 550.

Although FIG. 5 demonstrates a specific option for the shape and layout for the invention, additional form factor shapes and layout configurations would be consistent with the spirit of the invention, as described by FIG. 1. The physical shape and size of the device can vary widely. For example, the physical shape and size may be longer or shorter, flatter or rounder, more or less cylindrical, include additional or fewer appendages, or any other suitable shape and size.

Moreover, the location of components relative to the form factor could vary widely. For example, certain components of the invention, such one or more the sensors, may be located in any suitable position on-board, off-board, or a combination of on-board and off-board. Additionally, for example, certain components of the invention, such as the actuator 150, could be physically fastened within the device, but at a different location than shown by FIG. 5.

Moreover, the quantity, nature, characteristics, and specifications of the components may vary in a manner consistent with the functional decomposition as described in FIG. 1. For example, the invention may include additional, less, or a different combination of sensors. For example, the invention may include additional sensor or sensory biofeedback channels not described in FIG. 5, such as moisture sensors and/or breath rate sensors. Additionally, for example, the invention could include two or more force sensors 130-A, rather than one, as presently indicated by FIG. 5. Any suitable number, type, and combination of sensors can be used.

Figure 8:
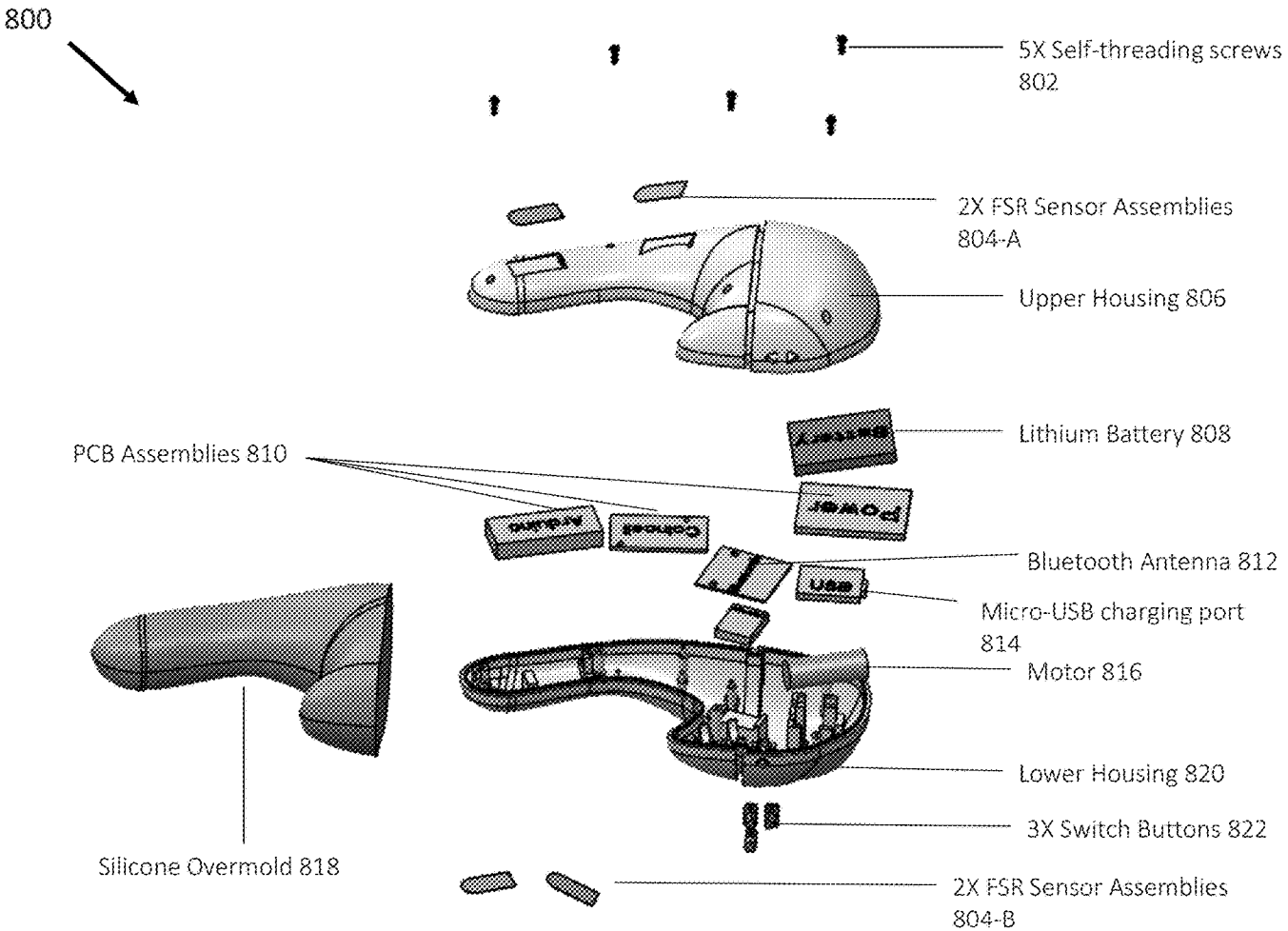
FIG. 8 illustrates a physiological measurement and stimulation device in accordance with an embodiment of the disclosed subject matter.

FIG. 8 illustrates a block diagram of another prototype 800 illustrating the stimulation device 110, according to some embodiments of the disclosed subject matter. As a non-limiting example, the prototype 800 illustrates a form factor shape and internal layout of the device 110. illustrates that the device 100 can include additional, less, or a different combination, and the location of components relative to the form factor could vary widely. The prototype 800 includes one or more self-threading screws 802, force sensing resistor (FSR) sensor assemblies 804-A and 804-B (collectively 804), an upper housing 806, a lithium battery 808, printed circuit board (PCB) assemblies 810, a Bluetooth antenna 812, a micro-USB charging port 814, a motor 816, a silicone overmold 818, a lower housing 820, and one or more switch buttons.

The FSR sensor assemblies 804 can be an example of the sensor 130 illustrated in FIG. 1. The FSR sensor assemblies 804 can be configured to measure externally exerted force, such as vaginal muscle contractions from the user's body.

The lithium battery 808 can be an example of the power supply 170 illustrated in FIG. 1. In some embodiments, the lithium battery 808 can power the FSR sensor assemblies 804, the PCB assemblies 810, the Bluetooth antenna 812, the micro-USB charging port 814, and the motor 816.

The PCB assemblies 810 can be an example of the controller 140 illustrated in FIG. 1. In some embodiments, the PCB assemblies can include a microprocessor and memory.

The Bluetooth antenna 812 can be an example of the transceiver 160 illustrated in FIG. 1. In some embodiments, the on-board components can communicate with the off-board components through the Bluetooth antenna 812.

The micro-USB charging port 814 can be an example of the transceiver 160 and/or the power supply 170 illustrated in FIG. 1. In some embodiments, the on-board components can communicate with the off-board components by connecting the off-board components to the micro-USB charging port 814. In some embodiments, an external power supply can be connected to the micro-USB charging port 814 to provide on-board components with power.

The motor 816 can be an example of the actuator 150 illustrated in FIG. 1. In some embodiments, the motor 816 can convert a command voltage signal into a stimulating vibration response onto the user's body.

The self-threading screws 802, the upper housing 806, the silicone overmold 818, the lower housing 820, and the switch buttons 822 can be used, without limitation, to assemble the external form factor of the prototype 800. As a non-limiting example, the form factor of the prototype 800 can be modified by changing the shape and/or size of the upper housing 806, the silicone overmold 818, and the lower housing 820.

It is to be understood that any of the processes described in FIGS. 2-4 can be executed on-board and/or off-board the physical embodiment of the invention. As an example, processes can be implemented within the outlined internal layout of the device in FIG. 5 or executed separately from a remote device and passed to the processes described.

Figure 6A:
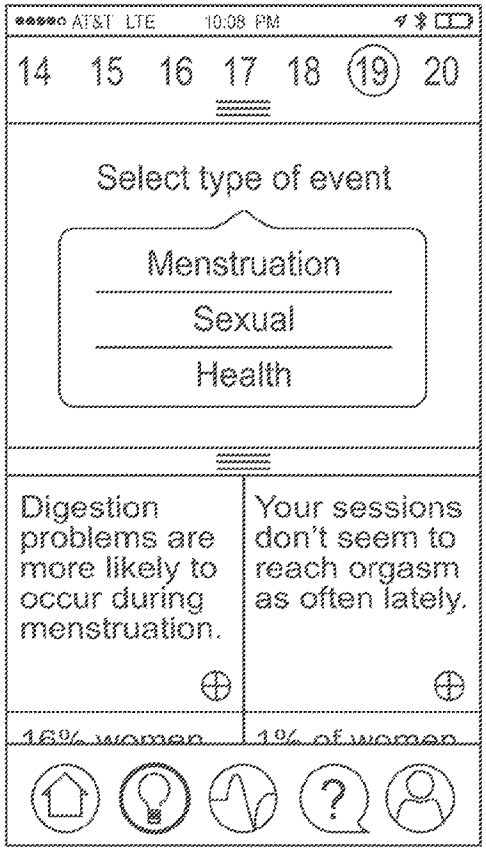
FIGS. 6(*a*) to 6(*c*) illustrate screenshots of the user interface in accordance with an embodiment of the disclosed subject matter.
Figure 6B:
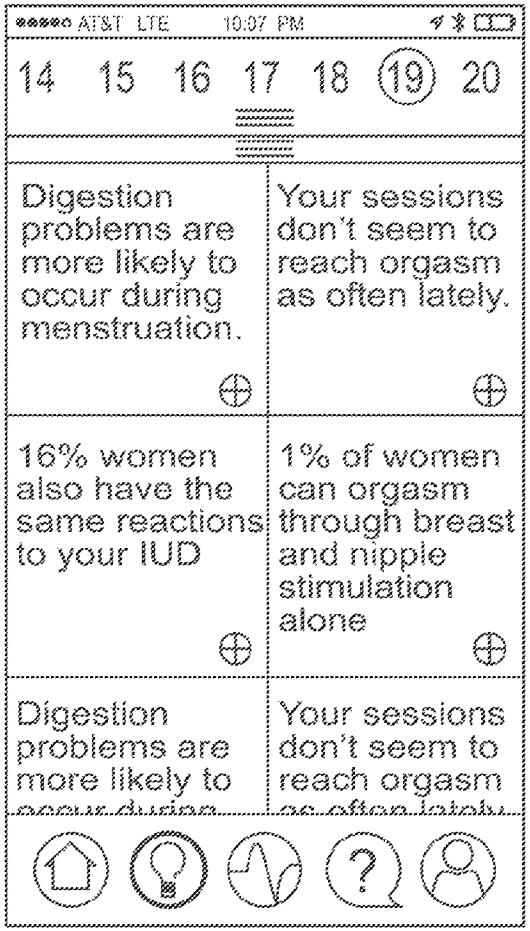
Figure 6C:
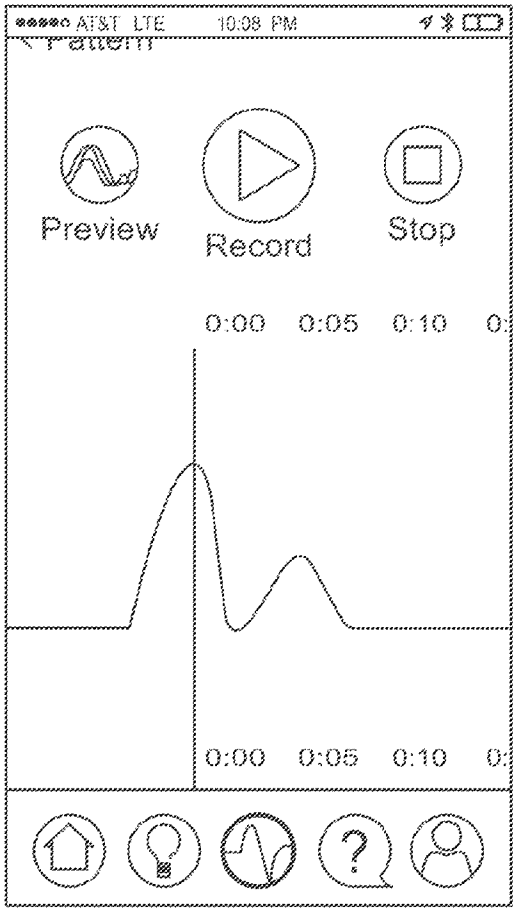

FIGS. 6(*a*) to 6(*c*) illustrate screenshots of the user interface of the data analyzer 120, according to some embodiments of the disclosed subject matter. As discussed earlier, in some embodiments, the data analyzer 120 can be implemented as a software application installed on a user equipment such as a smartphone, tablet computer, laptop computer, or desktop computer, and the user interface can be a screen display associated with the user equipment. Specifically, FIG. 6(*a*) provides a self-report for the user. The self-report can analyze the user data collected during the operation of the system 100 and report the user's information or activities in different types of events. In some embodiments, the self-report can also report one or more events identified by the user. For example, in FIG. 6(*a*), the user can select report for the following types of events: menstrual cycle, sexual activities, health information and/or any other suitable event.

FIG. 6(*b*) provides an insight report for the user. The insight report can analyze the user data collected during the operation of the system 100, and report items such as how frequently the user has reached orgasm using the system 100. In some embodiments, the insight report can also inform the user general health related information. Additionally, the insight report can also benchmark the user data with the population data, so that the user can get more insights about her physiological data comparing with other users. As non-limiting examples suggested by FIG. 6(*b*), the insight report can inform the user that she is more likely to have digestion problem during menstruation; that she do not seem to reach orgasm as often lately through the use of the device 110; that, after getting an intrauterine device (IUD), 16% women have experienced the same reactions (e.g., the decrease of libido) as the user has experienced; that 1% of women can reach orgasm through breast and nipple stimulation alone.

FIG. 6(*c*) illustrates a screenshot of the user interface for recording certain user data during the operation of the system 100. For example, the user data recorded can be any sensor data collected by the sensor 130. As shown in FIG. 6(*c*), in some embodiments, the user can also choose to stop and/or preview the recording. In some embodiments, the data analyzer 120 can use the user data to detect certain trends and patterns, and can recommend improved command signal classifier that can be autonomously or manually uploaded to the controller 140.

The present invention has been introduced in this application. The advantages of the present invention include, without limitation, the ability to measure levels of arousal and orgasms based on user physiological data collected by the sensor, for the device to autonomously adapt its actuation behavior based on user physiological data during operation of the device, and for the device to autonomously adapt its actuation behavior over multiple periods of operation based on sensory data indicating the preferences of the individual operator as well as the preferences of several operators with similar devices. These advantages enable people to measure and analyze their level of arousal and orgasm depending on a variety of factors.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter, which is limited only by the claims which follow.

What is claimed is:

1. A method for providing physiological stimulation, comprising:

(a) receiving, at a computing device, sensory data associated with at least an action of a first user from a sensor;

(b) receiving, at the computing device, a user setting;

(c) determining, at the computing device, a parameter based on the user setting, wherein the parameter is different from the user setting;

(d) generating, at the computing device, a command signal based on (1) the sensory data and (2) a command signal classifier that uses the parameter;

(e) sending, at the computing device, the command signal to an actuator, wherein the command signal is used to control motions of the actuator;

(f) receiving, at the computing device, updated sensory data from the sensor based on the motions of the actuator; and (g) determining, at the computing device, whether the updated sensory data have reached a predetermined threshold, and if the sensory data have not reached the predetermined threshold:

dynamically updating the parameter used by the command signal classifier in response to the updated sensory data received in step (f);

generating, at the computing device, an updated command signal based on (1) the updated sensory data and (2) the command signal classifier;

sending, at the computing device, the updated command signal to the actuator, wherein the updated command signal is used to control motions of the actuator, and repeating, at the computing device, steps (f) to (g) until the updated sensory data have reached the predetermined threshold.

2. The method of claim 1, further comprising:

generating the command signal and the updated command signal further based on the user setting.

3. The method of claim 1, further comprising updating, at the computing device, the command signal classifier based on at least one of the following:

the updated sensory data;

past data of the first user received at the computing device;

data of a second user received at the computing device; and the user setting.

4. The method of claim 1, further comprising updating, at the computing device, the predetermined threshold based on at least one of the following:

the updated sensory data;

past data of the first user received at the computing device;

data of a second user received at the computing device; and the user setting.

5. The method of claim 1, further comprising:

receiving, at the computing device, a new user setting; and replacing the user setting.

6. The method of claim 1, wherein the sensory data and the updated sensory data comprises at least one of the following:

force exerted against the sensor;

moisture level of the sensor;

surface temperature of the sensor;

heart rate of the user;

position of the sensor;

velocity of the sensor; and acceleration of the sensor.

7. The method of claim 1, wherein the command signal and the updated command signal are each a voltage.

8. The method of claim 1, wherein the user setting comprises at least one of the following:

physiological data of the first user; and intensity level of the actuator.

9. The method of claim 1, further comprising:

receiving, at the computing device, a new command signal classifier; and replacing the command signal classifier.

10. The method of claim 1, wherein determining whether the updated sensory data have reached a predetermined threshold further comprising:

calculating, at the computing device, a score based on the parameter and the received sensory data; and updating, at the computing device, the parameter to maximize the score.

11. The method of claim 1, wherein determining whether the updated sensory data have reached a predetermined threshold further comprising discarding a portion of the received sensory data as noise.

12. The method of claim 1, wherein the parameter includes an amplification gain.

13. An apparatus for providing physiological stimulation, comprising:

a sensor configured to sense data associated with at least an action of a first user;

an actuator configured to generate motions; and a controller, coupled to the sensor and the actuator, configured to run a module stored in memory that is configured to cause the controller to:

(a) receive sensory data from the sensor;

(b) receive a user setting;

(c) determine a parameter based on the user setting, wherein the parameter is different from the user setting;

(d) generate a command signal based on (1) the sensory data and (2) a command signal classifier that uses the parameter;

(e) send the command signal to the actuator, wherein the command signal is used to control motions of the actuator;

(f) receive updated sensory data from the sensor based on the motions of the actuator; and (g) determine whether the updated sensory data have reached a predetermined threshold, and if the sensory data have not reached the predetermined threshold:

dynamically update the parameter used by the command signal classifier in response to the updated sensory data received in step (f), generate an updated command signal based on (1) the updated sensory data and (2) the command signal classifier, send the updated command signal to the actuator, wherein the updated command signal is used to control motions of the actuator, and repeat steps (f) to (g) until the updated sensory data have reached the predetermined threshold.

14. The apparatus of claim 13, further comprising a data analyzer coupled to the controller and is configured to:

provide a user setting; and provide a new command signal classifier.

15. The apparatus of claim 14, wherein the module is further configured to cause the controller to:

receive the user setting from the data analyzer; and generate the command signal and the updated command signal further based on the user setting.

16. The apparatus of claim 15, wherein the module is further configured to cause the controller to update the command signal classifier based on at least one of the following:

the updated sensory data;

past data of the first user received from the data analyzer;

data of a second user received from the data analyzer; and the user setting.

17. The apparatus of claim 15, wherein the module is further configured to cause the controller to update the predetermined threshold based on at least one of the following:

the updated sensory data;

past data of the first user;

data of a second user received from the data analyzer; and the user setting.

18. The apparatus of claim 14, wherein the module is further configured to cause the controller to:

receive a new user setting from the data analyzer; and replace the user setting.

19. The apparatus of claim 13, wherein the user setting comprises at least one of the following:

physiological data of the first user; and intensity level of the actuator.

20. The apparatus of claim 13, wherein the module is further configured to cause the controller to:

receive the new command signal classifier from the data analyzer; and replace the command signal classifier.

21. The apparatus of claim 13, wherein the actuator is a vibrator.

22. The apparatus of claim 13, wherein the sensor is at least one of the following:

force sensor;

temperature sensor;

heart rate sensor;

moisture sensor; and breath rate sensor.

23. The apparatus of claim 13, wherein the module is further configured to cause the controller to calculate a score based on the parameter and the received sensory data; and update the parameter to maximize the score.

24. The apparatus of claim 13, wherein the module is further configured to cause the controller to discard a portion of the received sensory data as noise.

25. The apparatus of claim 13, wherein the parameter includes an amplification gain.

26. A non-transitory computer readable medium comprising executable instructions operable to cause an apparatus to (a) receive sensory data from the sensor;

(b) receive a user setting;

(c) determine a parameter based on the user setting, wherein the parameter is different from the user setting;

(d) generate a command signal based on (1) the sensory data and (2) a command signal classifier that uses the parameter;

(e) send the command signal to the actuator, wherein the command signal is used to control motions of the actuator;

(f) receive updated sensory data from the sensor based on the motions of the actuator; and (g) determine whether the updated sensory data have reached a predetermined threshold, and if the sensory data have not reached the predetermined threshold:

dynamically update the parameter used by the command signal classifier in response to the updated sensory data received in step (f), generate an updated command signal based on (1) the updated sensory data and (2) the command signal classifier, send the updated command signal to the actuator, wherein the updated command signal is used to control motions of the actuator, and repeat steps (f) to (g) until the updated sensory data have reached the predetermined threshold.

27. The apparatus of claim 26, wherein the non-transitory computer readable medium further comprising executable instructions operable to cause an apparatus to calculate a score based on the parameter and the received sensory data; and update the parameter to maximize the score.

28. The apparatus of claim 26, wherein the non-transitory computer readable medium further comprising executable instructions operable to cause an apparatus to discard a portion of the received sensory data as noise.

29. The apparatus of claim 26, wherein the parameter includes an amplification gain.

* * * * *